United States Patent [19]

Boik

[11] 4,261,193

[45] Apr. 14, 1981

[54] NECKED-IN AEROSOL CONTAINER-METHOD OF FORMING

[75] Inventor: Arnold R. Boik, Orland Park, Ill.

[73] Assignee: The Continental Group, Inc., Stamford, Conn.

[21] Appl. No.: 36,702

[22] Filed: May 7, 1979

Related U.S. Application Data

[62] Division of Ser. No. 934,924, Aug. 18, 1978, Pat. No. 4,173,883.

[51] Int. Cl.[3] ..... B21D 22/00

[52] U.S. Cl. ..... 72/349; 72/367; 72/370; 113/120 M; 113/120 S; 113/120 Z

[58] Field of Search ..... 72/347, 348, 349, 370, 72/367; 113/120 S, 120 M, 120 Z, 1 G

[56] References Cited

U.S. PATENT DOCUMENTS

| | | | |
|---|---|---|---|
| 1,375,305 | 4/1921 | Mariel | 72/349 |
| 3,172,386 | 3/1965 | West | 113/120 M |
| 3,786,957 | 1/1974 | Hilgenbrink | 113/120 Z |
| 3,964,412 | 6/1976 | Kitsuda | 113/120 S |
| 3,995,572 | 12/1976 | Saunders | 113/120 H |

FOREIGN PATENT DOCUMENTS

| | | | |
|---|---|---|---|
| 2526730 | 11/1976 | Fed. Rep. of Germany | 72/407 |
| 484282 | 5/1938 | United Kingdom | 113/120 M |

*Primary Examiner*—Leon Gilden
*Attorney, Agent, or Firm*—Charles E. Brown

[57] ABSTRACT

An apparatus and method for forming integral domed can bodies for aerosol cans. The apparatus is in the form of plural sets of tools, each set of tools including an inside tool and an outside tool so related as progressively to reduce the diameter of an end portion of the tubular body and in doing so gradually increasing the axial extent of an intermediate frustoconical portion. Each frustoconical intermediate portion is increased in extent axially by seating the previously formed portion on the inside tool and then shaping the blank on that same surface, whereby there is no interruption or stepping of the formed frustoconical intermediate portion of the blank.

4 Claims, 7 Drawing Figures

NECKED-IN AEROSOL CONTAINER-METHOD OF FORMING

This is a division of application Ser. No. 934,924 filed Aug. 18, 1978 now U.S. Pat. No. 4,173,883.

This invention relates in general to new and useful improvements in containers, and more specifically to an aerosol container having an integral dome wherein the container is formed from a cylindrical can body having a longitudinal side seam and wherein the dome is formed by a progressive necking process.

It is known to make aerosol containers either by providing a cylindrical container body with a special end or by shaping the end of a container particularly when the container is formed of readily workable metal, such as aluminum. However, the forming of a dome on a steel can body has heretofore been impractical from a commercial standpoint.

It is known to reduce the diameter of an end portion of a can body by a series of necking-in operations. However, in such can bodies in lieu of the conventional smooth dome appearance there has been either a series of steps or a very rippled appearance in previous attempts.

In accordance with this invention it is proposed to form a dome on a cylindrical can body by a series of necking-in steps wherein the end portion is first formed with a narrow frustoconical intermediate portion and in succeeding operations the previously formed frustoconical intermediate portion is supported by a shoulder of an inside tool and is extended radially inwardly by an outside tool cooperating with that same supporting shoulder so that in each necking-in of the end portion the frustoconical intermediate portion is merely extended.

In accordance with this invention, by utilizing a progressive necking process and in every instance supporting the previously formed frustoconical intermediate portion on a support surface in advance of the next succeeding necking-in operation and by extending the frustoconical intermediate portion during each necking step, a smooth transition between diameters can be effected, with the resultant frustoconical intermediate portion defining the dome as would customarily be provided in a separate component.

Most particularly, it has been found that the necessary reduction in diameters as required to receive an aerosol valve may be effected from a steel can body having a welded side seam without rupturing the side seam during the necking steps.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
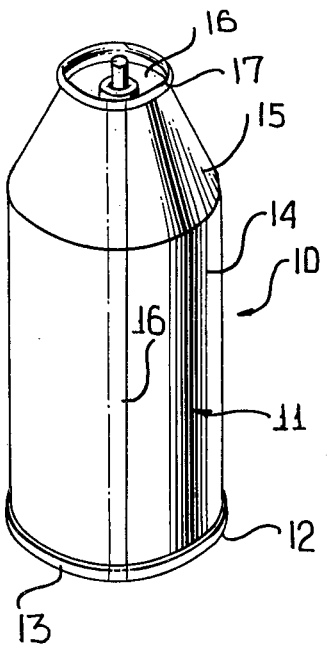
FIG. 1 is a top perspective view of an aerosol can formed in accordance with this invention utilizing a cylindrical steel can body as the starting component.
Figure 2:
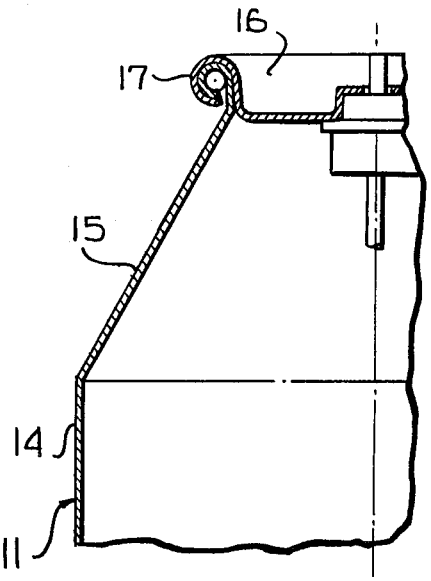
FIG. 2 is an enlarged fragmentary sectional view taken through the upper part of the aerosol can of FIG. 1, and shows more specifically the details thereof.

Referring now to the drawings, it will be seen that there is illustrated in FIG. 1 an aerosol can or container generally identified by the numeral 10. The can 10 has the customary appearance of an aerosol can and differs therefrom in that the body is formed of steel and has a longitudinal side seam, preferably formed by welding. Most specifically, the aerosol can 10 includes a body generally identified by the numeral 11 which is closed at its lower end by a conventional end unit 12 secured thereto by means of a conventional seam 13. The can body 11 has a cylindrical portion 14 which extends a major portion of its height. The cylindrical portion 14 terminates in a frustoconical dome 15 which is integral with the cylindrical portion 14. The body 11 has a longitudinal side seam 16 which extends the full height of the body.

The upper end of the body 11 is closed by a conventional aerosol valve assembly 16 which is secured to the upper end of the dome 15 by a conventional seam 17.

This invention particularly relates to the manner in which the can body 11 is formed.

Figure 3:
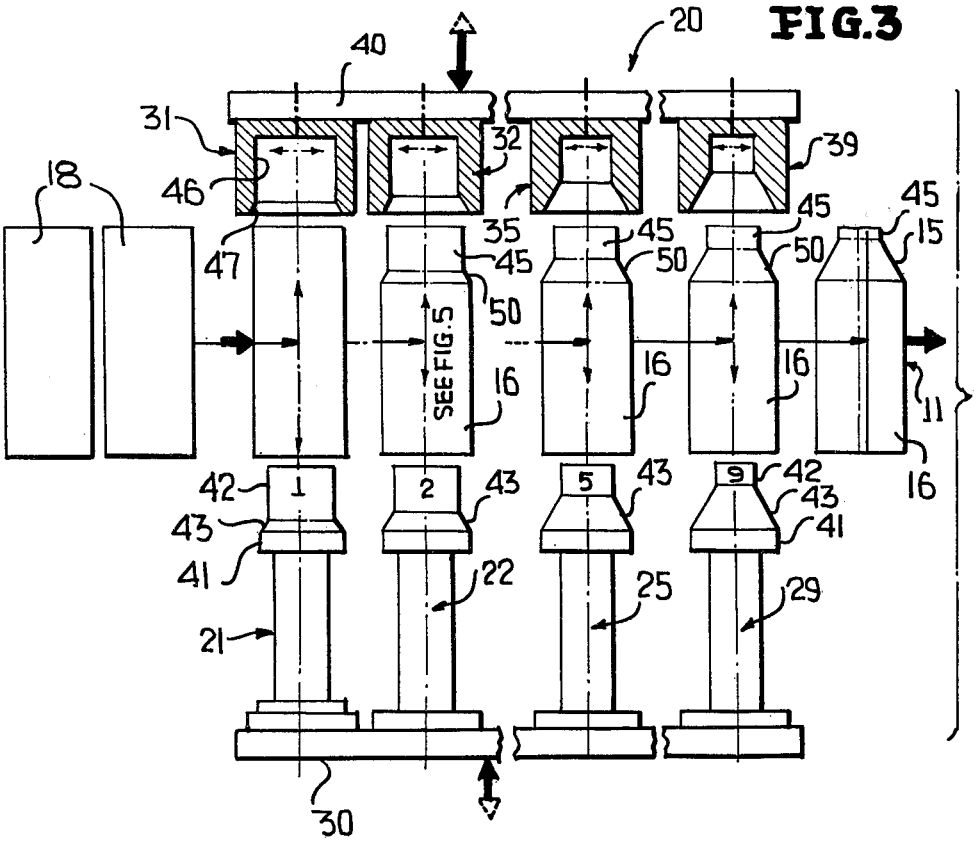
FIG. 3 is a schematic side elevational view of tooling showing the manner in which a tubular can body is progressively necked to have at one end thereof the conventional aerosol dome.

Referring now to FIG. 3, it will be seen that each can body 11 starts as a cylindrical body blank 18. In accordance with this invention each body blank 18 is preferably formed of a steel sheet which is rolled to a cylindrical configuration and with overlapping edges thereof secured together by welding in the longitudinal side seam 16. It is to be understood that the invention is not so limited in that it is feasible that the cylindrical body blank 18 be formed of other metals including aluminum which may have a welded longitudinal side seam. Further, it is feasible that the side seam could be of a bonded construction.

In FIG. 3 there is illustrated tooling generally identified by the numeral 20. The illustrated tooling preferably is of a 9-step tooling, but the number of steps is not considered to be limiting. The tooling 20 includes inside tools 21–29 of which only inside tools 21, 22, 25 and 29 are specifically illustrated. The tooling 20 also includes outside tools 31–39 of which only tools 31, 32, 35 and 39 are specifically illustrated. The inside tools 21–29 are mounted on a common platen 30 for reciprocatory movement in unison while the outside tools 31–39 are mounted on a common platen 40. The outside tools 31–39 are mounted to float relative to the platen 40 and the platen 40 may be selectively fixed or mounted to reciprocate toward and away from the platen 30 in timed relation to the reciprocation thereof.

It is particularly pointed out here that the tools 21–29, while they are mounted to move axially with the platen 30, are fixed to the platen 30 against movement transversely of their respective axes. On the other hand, while the tools 31–39 are fixed against axial movement relative to the platen 40, they are mounted so that they may float slightly with respect to their respective axes.

It is to be understood that when the body blank 18 has a welded side seam or like side seam, the wall thickness of the body blank 19 is greater at the side seam than it is elsewhere about the circumference of the body blank. It is not commercially feasible to attempt to orient the side seams with the tooling, and therefore in order to maintain the required clearance at all circumferential points between the tools of each set of tooling, it is necessary that the outside tools be permitted to float radially. This is generally in accordance with the patent to Hilgenbrink, U.S. Pat. No. 3,845,653.

Figure 5:
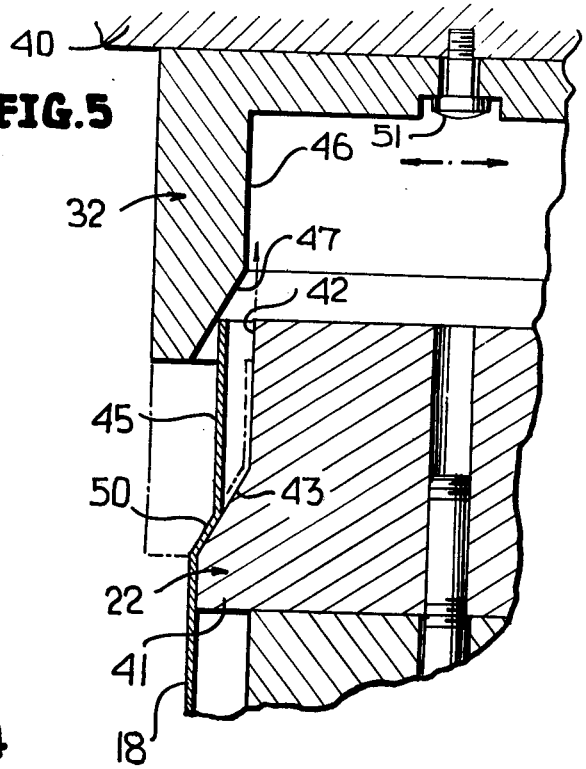
FIG. 5 is a fragmentary sectional view taken through a portion of the tooling as indicated by reference SEE FIG. 5 on FIG. 3.

Referring now to FIGS. 3 and 5 in particular, it will be seen that each side tool includes a base portion 41 and a free end portion 42 which are joined together by a frustoconical intermediate portion 43. In all of the tools 21–29, the base portion 41 remains of a constant diameter. On the other hand, the diameter of the free end portion 42 progressively decreases so that with respect to the last inside tool 29, the diameter of the base portion 41 is substantially twice the diameter of the free end portion 42. In fact, with respect to the particular aerosol can which is being made, the cylindrical body portion 14 has a diameter of 2 2/16 inch, whereas a tubular end portion 45 (FIGS. 3 and 6) has a diameter of 1 inch.

It will be readily apparent from the illustration of the inside tools 21–29 that as the diameter of the free end portion 42 progressively decreases, the axial extend of the frustoconical intermediate portion 43 increases.

Also referring to FIGS. 3 and 5, it will be seen that each outside tool 31 has a primary cylindrical portion 46 in the form of a bore, with there being a tapered entrance 47. The tapered entrance 47 is also frustoconical and is at the same angle to the axis of the tooling as the frustoconical intermediate portion 43 of each of the inside tools. It will be readily apparent from FIG. 3 that the diameter of the cylindrical portion 46 progressively decreases at the same rate as does the free end portion 42 of the inside tooling. Further, the tapered entrance 47 progressively extends into the outside tool as the internal diameter decreases, so that the entrance 47 has an axial length corresponding substantially to the axial length of the corresponding frustoconical intermediate portion 43.

At this time it is pointed out that the platens 30, 40, other than being in spaced opposed relation and being selectively reciprocal toward and away from one another, may have any desired orientation. For example, the platens 30, 40 may be horizontally disposed and mounted for vertical movement, or they may be vertically disposed and mounted for horizontal movement.

Suitable means will be provided for advancing the body blanks 18 and the partially formed container bodies sequentially relative to the sets of inside and outside tools. The tools may be arranged in line, in which event the blanks and partially formed bodies will be moved along a straight line. On the other hand, the bodies and blanks may be carried by a turret which, depending upon the orientation of the platens 30, 40, may be indexed about either a horizontal or a vertical axis.

Figure 4:
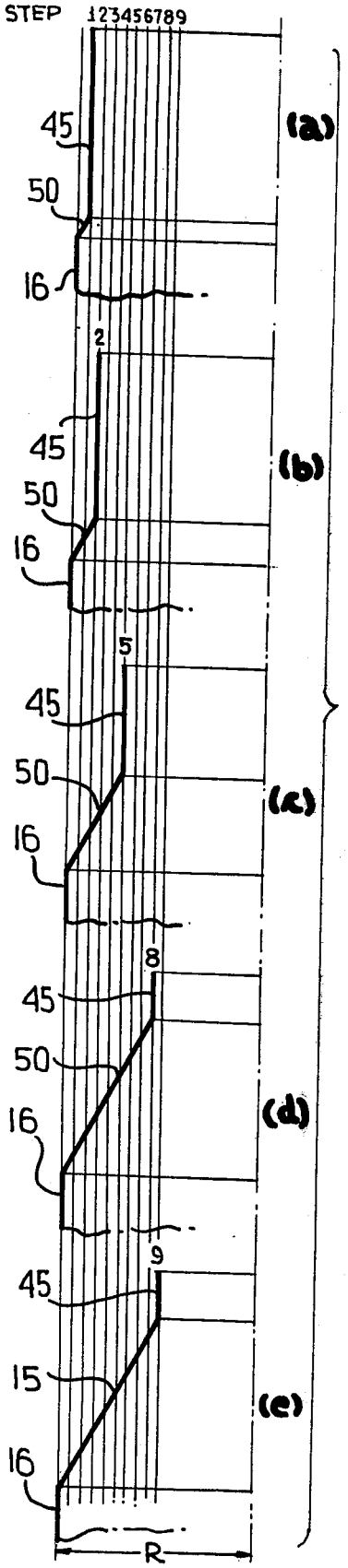
FIG. 4 is a series of sectional views taken through the upper portion of a can body as it is progressively necked in accordance with this invention.

In accordance with this invention, and as is best shown in FIGS. 3 and 4, a cylindrical body blank 18 will have received therein the inside tool 21. Then, by effecting relative movement between the inside tool 21 and the associated body blank on the one hand, and the outside tool 31 on the other hand to effect a telescoping, the initially cylindrical blank 18 has a free end portion 45 thereof reduced in diameter and at the same time there is formed a frustoconical intermediate portion 50 of a limited width.

Referring now to FIG. 5, it will be seen that when the inside tool 22 enters the blank 18 after the first operation has been performed thereon, the base portion 41 of the inside tool snugly enters the cylindrical main portion of the blank so as to center the blank on the inside tool 22. Next, the frustoconical intermediate portion 50 seats on the frustoconical intermediate portion 43 of the inside tool 22. The cylindrical free end portion 45 is of a larger diameter than the free end portion 42 of the inside tool 22, and is spaced therefrom.

Then, the outside tool 32 moves into telescoping engagement with the free end portion 45 with the result that the tapered entrance 47 engages the free end portion 45 and begins progressively to reduce the diameter thereof. At the same time, the outside tool 32, which is illustrated as being attached to the platen 40 for radial floating movement by a pin 51, centers itself, taking into consideration the extra thickness of the side seam 16.

As the telescoping of the tools continues, the free end portion of the partially formed body is deformed or necked radially inwardly around the end portion 42 of the inside tool 22. Finally, the tapered entrance 47 has the surface thereof initiate the deformation of the prior inner part of the free end portion 45 against the frustoconical intermediate portion 43 of the inside tool 22. Since the surface of the tapered entrance 47 matches that of the shoulder defined by the frustoconical intermediate portion 43, there is a full flattening operation so that the axial extent of the frustoconical intermediate portion 50 is increased in a manner wherein there are no tool markings and the increased portion forms a full continuation of the previously formed frustoconical intermediate portion 50 notwithstanding the fact that the frustoconical intermediate portion 50 does have the greater thickness side seam 16 extending axially therealong and the orientation of the side seam may change from tool set to tool set.

Figure 6:
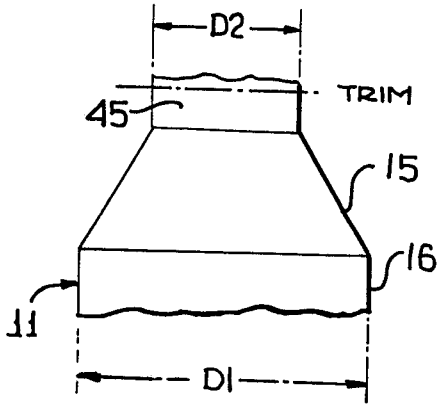
FIG. 6 is an enlarged fragmentary side elevational view showing the upper portion of a domed can body prior to trimming.
Figure 7:
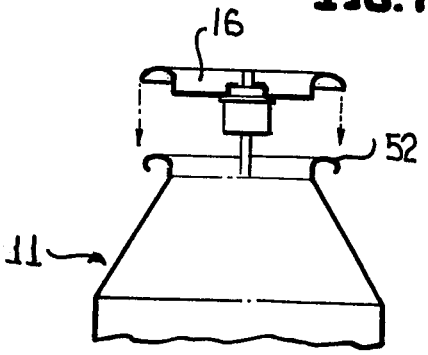
FIG. 7 is a fragmentary sectional view taken through the upper part of the trimmed can body of FIG. 6, and shows the same having applied thereto a conventional aerosol valve assembly.

The necking continues in the same manner as that illustrated in FIG. 5 until the free end portion 45 is of the desired final diameter and the general overall shaping of the can body 11 is completed. At this time, as shown in FIG. 6, the reduced diameter free end portion 45 is trimmed to the desired height, after which it is provided with a curl 52 in a conventional manner for receiving the aerosol valve unit 16.

Reference is momentarily made here to the schematic showings of FIG. 4 wherein the progressive necking of the cylindrical blank 18 into the domed can body 11 is shown, with there being 9 sets of tools and therefore 9 necking operations. It is to be understood that the number of necking operations would depend upon the material of the can body and the degree of reduction in diameter.

Although the invention has been specifically illustrated and described in conjunction with the formation of an integral dome on a cylindrical can body, it is to be understood that the same apparatus and method could be utilized in forming transitions between large diameter and smaller diameter portions on other articles.

It is also to be understood that while only a preferred embodiment of the invention has been specifically illustrated and described herein, minor variations may be made in the apparatus, the utilization thereof and the resultant product without departing from the spirit and scope of the invention as defined by the appended claims.

What is claimed as new is:

1. A method of necking-in a tubular member, said method comprising the steps of reducing the diameter of a free end portion of the tubular member and forming a frustoconical intermediate portion between said reduced diameter free end portion and the remainder of the tubular member, seating the tubular member intermediate portion on a complimentary frustoconical support surface which extends radially inwardly and axially beyond the tubular member intermediate portion, and then further reducing the diameter of the free end portion and increasing the extent of the tubular member intermediate portion radially inwardly and axially against the support surface.

2. The method of claim 1 wherein the further reduction of the free end portion and the increasing of the extent of the tubular member intermediate portion is effected by a floating outside tool.

3. The method of claim 1 wherein said further reduction of the free end portion and the increasing of the extent of the tubular member intermediate portion is repeated until the diameter of the free end portion is on the order of ½ of the original diameter.

4. The method of claim 1 wherein said further reduction of the free end portion and the increasing of the extent of the tubular member intermediate portion is repeated until the diameter of the free end portion is on the order of ½ of the original diameter, and said free end portion is then trimmed and curled to form an aerosol can.

* * * * *